US011532412B2

(12) United States Patent
Zhang et al.

(10) Patent No.: US 11,532,412 B2
(45) Date of Patent: Dec. 20, 2022

(54) SAMARIUM-COBALT MAGNETS AND METHOD FOR PREPARING THE SAME

(71) Applicant: Baotou Tianhe Magnetics Technology Co., Ltd., Baotou (CN)

(72) Inventors: Bingjun Zhang, Baotou (CN); Yi Dong, Baotou (CN); Zhimin Wu, Baotou (CN); Shulin Diao, Baotou (CN); Xin Liu, Baotou (CN); Jianyun Su, Baotou (CN); Yuelin Fan, Baotou (CN); Bo Yuan, Baotou (CN); Yi Yuan, Baotou (CN); Ya Chen, Baotou (CN); Wenjie Yuan, Baotou (CN)

(73) Assignee: Baotou Tianhe Magnetics Technology Co., Ltd.

( * ) Notice: Subject to any disclaimer, the term of this patent is extended or adjusted under 35 U.S.C. 154(b) by 297 days.

(21) Appl. No.: 16/743,494

(22) Filed: Jan. 15, 2020

(65) Prior Publication Data

US 2020/0243233 A1 Jul. 30, 2020

(30) Foreign Application Priority Data

Jan. 28, 2019 (CN) ..... 201910079041.7

(51) Int. Cl.

| | |
|---|---|
| ***H01F 1/055*** | (2006.01) |
| ***B22F 3/04*** | (2006.01) |
| ***B22F 3/24*** | (2006.01) |
| ***C22C 19/07*** | (2006.01) |

(52) U.S. Cl.

CPC ..... *H01F 1/0557* (2013.01); *B22F 3/04* (2013.01); *B22F 3/24* (2013.01); *C22C 19/07* (2013.01); *B22F 2003/248* (2013.01); *B22F 2301/155* (2013.01); *B22F 2998/10* (2013.01); *C22C 2202/02* (2013.01)

(58) Field of Classification Search

CPC .. H01F 1/0557; B22F 3/04; B22F 3/24; B22F 2003/248; B22F 2301/155; B22F 2998/10; C22C 19/07; C22C 2202/02

See application file for complete search history.

(56) References Cited

FOREIGN PATENT DOCUMENTS

| | | | | |
|---|---|---|---|---|
| CN | 101882494 | A | 11/2010 | |
| CN | 102290180 | A | 12/2011 | |
| CN | 102543418 | A | 7/2012 | |
| CN | 102568807 | A | 7/2012 | |
| CN | 103065752 | A | 4/2013 | |
| CN | 103325513 | A | 9/2013 | |
| CN | 105355352 | A | 2/2016 | |
| CN | 107564645 | A | 1/2018 | |
| EP | 1679724 | A1 * | 7/2006 | ..... B22F 1/0055 |
| WO | WO-2011032432 | A1 * | 3/2011 | ..... C22C 38/005 |
| WO | 2013002294 | A1 | 1/2013 | |

OTHER PUBLICATIONS

Liu et al, CN 101882494 A alternate translation, Nov. 10, 2010 (Year: 2010).*

John Ormerod, The Physical Metallurgy and Processing of Sintered Rare Earth Permanent Magnets, 1985, Elsevier Sequoia, Journal of the Less-Common Metals 111, p. 49-69 (Year: 1985).*

B. W. Rolfe, Paper 18 Cold Isostatic Presses: Equipment and Techniques Used at A.W.R.E., May 16, 1967, Proceedings of the Institution of Mechanical Engineers, vol. 182 Pt 3 C, pp. 239-248 (Year: 1967).*

Chinese Search Report for Application No. 201910079041.7 dated Jan. 21, 2020, 2 pages.

* cited by examiner

*Primary Examiner* — Nicholas A Wang
*Assistant Examiner* — Maxwell Xavier Duffy
(74) *Attorney, Agent, or Firm* — Lerner, David, Littenberg, Krumholz & Mentlik, LLP

(57) ABSTRACT

The present invention provides a samarium-cobalt magnet and a method for preparing the same. The method comprises mixing an alloy powder with a zirconium powder in an amount of 0.1-0.35 wt % of the weight of the alloy powder to form a mixture. The alloy powder is formed from 10.5-13.5 wt % of samarium, 12.5-15.5 wt % gadolinium, 50-55 wt % of cobalt, 13-17 wt % of iron, 4-10 wt % of copper, and 2-7 wt % of zirconium. The method brings about at low costs a samarium-cobalt magnet having a positive temperature coefficient of remanence.

1 Claim, No Drawings

SAMARIUM-COBALT MAGNETS AND METHOD FOR PREPARING THE SAME

CROSS REFERENCE TO RELATED APPLICATIONS

The present application claims priority from Chinese Patent Application No. 201910079041.7, filed on Jan. 28, 2019, the entire content of which is incorporated herein by reference.

TECHNICAL FIELD OF THE INVENTION

The present invention relates to a samarium-cobalt magnet and a method for preparing it, in particular to a samarium-cobalt magnet having a positive temperature coefficient of remanence and a method for preparing the same.

BACKGROUND OF THE INVENTION

High temperature resistance magnetic materials are fundamental metal-based functional materials. At present, commercially available samarium-cobalt magnets (such as $Sm_2Co_{17}$ magnet) usually have a negative temperature coefficient of remanence (e.g., $\alpha(Br)=-0.011\%$), which means that the remanence decreases as the temperature increases.

CN101882494A discloses a method for preparing a samarium-cobalt-based sintered magnet material. In the material, samarium accounts for 10-25%, cobalt accounts for 45-55%, iron, 10-20%, copper, 3-9%, zirconium, 1-3%, and a heavy rare-earth element, 5-15%, by mass. In this method, all the starting materials are directly blended. Also, as shown in the example given in the description, the content of samarium is so high as to result in a negative temperature coefficient of remanence, e.g., −0.005 to −0.03%/° C. CN103325513A discloses a method for preparing a samarium-cobalt permanent magnet material. In the material, samarium accounts for 24.5-26%, cobalt accounts for 52-56%, iron, 7.5-12%, copper, 6.5-8%, and zirconium 2-4%. CN102290180A discloses a method for preparing a rare earth permanent magnet material. The material comprises 14-20% of samarium, 45-50% of cobalt, 12-16% of iron, 3-7% of copper, 1-3% of zirconium, and 5-15% of a heavy rare-earth element. In all the above-mentioned methods, the starting materials are directly blended, and the products have such a high content of samarium that leads to a negative temperature coefficient of remanence.

CN107564645A discloses a method for preparing a samarium-cobalt permanent magnet material for use in high temperatures that has a low temperature coefficient of remanence. This permanent magnet material can be expressed by $Sm_{1-x-y}Er_xLa_y(Co_{1-u-v-w}Fe_uCu_vZr_w)_z$, where x=0-0.40, y=0-0.03, u=0.10-0.20, v=0.06-0.10, w=0.02-0.04, and z=7.4-7.8. In this method, all the starting materials are directly blended. Also, the content of samarium is so high as to result in a negative temperature coefficient of remanence. (The apparently contradictory thing for this patent document is that although the claims recite the temperature coefficient of remanence as a positive value, it is invariably a negative value in all the examples given in the description.)

For some applications, such as motors, data sensors and aerospace accessories, magnet materials characterized by remanence that does not change with the temperature at high temperatures are desirable. No doubt, samarium-cobalt magnets having a positive temperature coefficient of remanence are more favorable. A positive temperature coefficient of remanence means that the remanence increases as the temperature increases.

CN103065752A discloses a method for preparing a permanent magnet material having a linear temperature coefficient of remanence. Alloy A and alloy B are smelted respectively in a vacuum induction furnace. The resultant alloys A and B are comminuted into a powder of millimeter sizes. After being mixed at a certain ratio, powders of alloys A and B are further ground and fully mixed under protection by a medium. The subsequent steps of shaping, sintering, solution treatment, and step-by-step isothermal aging give rise to a permanent magnet material having a linear temperature coefficient of remanence. The alloy A is a samarium-cobalt material without a heavy rare-earth element, and the alloy B is a material containing a heavy rare-earth element (HRE). This method results in a samarium-cobalt magnet having a linear temperature coefficient of remanence in a temperature ranging from 20-30° C. to 100° C. However, this method needs to mix the powders of two alloys which have to be prepared separately, so its cost of production is remarkably high.

SUMMARY OF THE INVENTION

An objective of the present invention is to provide a method for preparing a samarium-cobalt magnet. The method features low costs and brings about a samarium-cobalt magnet having a positive temperature coefficient of remanence. Further, this method produces a samarium-cobalt magnet having high remanence and high coercive force at high temperatures. Another objective of the present invention is to provide a samarium-cobalt magnet prepared by the method.

The present invention provides a method for preparing a samarium-cobalt magnet, comprising:

mixing an alloy powder with a zirconium powder to form a mixture, and subjecting the mixture to post-processing, wherein the alloy powder is formed from the following starting materials, based on the weight of the alloy powder:

10.5-13.5 wt % of samarium,
12.5-15.5 wt % gadolinium,
50-55 wt % of cobalt,
13-17 wt % of iron,
4-10 wt % of copper, and
2-7 wt % of zirconium, wherein the sum of the weight percentages of the starting materials being 100 wt %; and wherein the weight of the zirconium powder is 0.1-0.35% of the weight of the alloy powder.

According to the method, preferably, the alloy powder is formed from the following starting materials, based on the weight of the alloy powder:

11.5-13 wt % of samarium,
13-14.5 wt % gadolinium,
50-53 wt % of cobalt,
15-17 wt % of iron,
6-10 wt % of copper, and
2-5 wt % of zirconium, wherein the sum of the weight percentages of the starting materials being 100 wt %.

According to the method, preferably, the alloy powder is formed from the following starting materials, based on the weight of the alloy powder:

12.5-13 wt % of samarium,
13-13.5 wt % gadolinium,
50-51 wt % of cobalt, 15-16 wt % of iron, 6-8 wt % of copper, and 2-3 wt % of zirconium, wherein the sum of the weight percentages of the starting materials being 100 wt %.

According to the method, preferably, the weight of the zirconium powder is 0.1-0.2% of the weight of the alloy powder.

According to the method, preferably, the alloy powder has an average particle diameter of 3-5 μm, and the zirconium powder has an average particle diameter of 1-10 μm.

According to the method, preferably, the post-processing comprises magnetic-field shaping, isostatic pressing, sintering and solution treatment, and aging.

According to the method, preferably, the magnetic-field shaping is to press the mixture under the action of an alignment magnetic field in a magnetic field press machine to give a compact having a density of 3.8-4.5 g/cm$^3$; the isostatic pressing is to wrap the compact with a plastic bag, evacuate the plastic bag, and then cold-isostatically press the compact in an isostatic pressing machine at 15-24 MPa for 10-30 seconds to give a green compact having a density of 4.8-5.4 g/cm$^3$.

According to the method, preferably, the sintering and solution treatment is to place the green compact in a vacuum sintering furnace, evacuate the vacuum sintering furnace to a vacuum degree of 0.2 Pa or less, gradually heat the green compact, and sinter the green compact at 1210-1230° C. for 0.5-1 hour to give a sinter, cool the sinter to 1200-1180° C., perform solution treatment of the sinter for 2-6 hours, and quickly air cool the sinter to 20-30° C.; the aging is to heat the sinter to 800-850° C., keep it at that temperature for 10-20 hours, cool it to 350-450° C. at 0.5-0.8° C./min, keep it at that temperature for 4-10 hours, and air cool it to 20-30° C., thereby giving the samarium-cobalt magnet.

The present invention further provides a samarium-cobalt magnet prepared by the method according to the present invention, wherein the samarium-cobalt magnet has a positive temperature coefficient of remanence at 20-200° C., remanence of 7.8 kGs or more at 150° C., and a coercive force of 20 kOe or more at 150° C.

The samarium-cobalt magnet according to the present invention preferably has the remanence of 8.2 kGs or more at 200° C., and the coercive force of 17 kOe or more at 200° C.

The present invention produces at low costs a samarium-cobalt magnet having a positive temperature coefficient of remanence by directly mixing an alloy powder and a zirconium powder and controlling the content of samarium and gadolinium. Further, the present invention produces a samarium-cobalt magnet having high remanence and a high coercive force at high temperatures by adjusting the amount of each of the starting materials and the order of the steps in the post-processing.

DETAILED DESCRIPTION OF EMBODIMENTS

The following is a detailed description of the present invention using embodiments, but the scope of protection of the present invention is not limited to them.

In the present invention, the term "temperature coefficient of remanence" means in a range where a magnet can operate, the percentage of a change in residual magnetic induction of the magnet corresponding to every 1° C. change in an environment where the magnet is located. A temperature coefficient of remanence is represented by the following expression:

$$a = \frac{Br(T) - Br(T0)}{Br(T0)(T - T0)} \times 100\%.$$

In the present invention, the term "remanence" means the value of the magnetic flux density corresponding to the magnetic field intensity of zero on the hysteresis loop. Remanence is usually denoted by Br or Mr, in the unit of Tesla (T) or Gauss (Gs). 1 T=10 kGs.

In the present invention, the term "coercive force" means the intensity of a magnetic field that brings to zero the magnetization of a magnet from the saturation magnetization of the magnet along the hysteresis loop when the magnetic field is monotonically decreased to zero and then caused to operate in the opposite direction. A coercive force is usually denoted by $H_{cJ}$, in the unit of Oe. 1 Oe=79.6 A/m.

In the present invention, the "inert atmosphere" refers to an atmosphere that does not react with the magnet and does not affect its magnetic properties. In the present invention, the "inert atmosphere" includes an atmosphere formed by nitrogen or an inert gas (helium, neon, argon, krypton, or xenon).

In the present invention, "vacuum" means an absolute degree of vacuum of 0.1 Pa or less, preferably 0.01 Pa or less, and more preferably 0.001 Pa or less. In the present invention, the smaller the absolute degree of vacuum is, the higher the vacuum degree is.

In the present invention, the "average particle diameter" refers to particle size distribution D50, which is the value of the particle diameter at 50% in the cumulative distribution.

The method according to the present invention comprises the steps of mixing and post-processing. Before the mixing, the method may further comprise smelting, powdering, or the like. The following is a detailed description of the steps.

<Smelting>

The step of smelting is to turn a magnet starting material into a master alloy by smelting the magnet starting material. To prevent the magnet starting material and the master alloy from being oxidized, the smelting is preferably performed in a vacuum or an inert atmosphere. The smelting is preferably performed by a casting process or a strip casting process. The casting process is to form a master alloy by cooling and solidifying the smelted magnet starting material. The strip casting process is to rapidly cool and solidify the smelted magnet starting material and spin it into a master alloy. In the present invention, the smelting may be performed in a high-vacuum high-frequency induction furnace. The smelting temperature may be 1100-1600° C., and preferably 1450-1500° C. In the present invention, the thickness of the master alloy may be 0.01-5 mm, preferably 0.-1 mm, and more preferably 0.25-0.35 mm. The content of oxygen is 2000 ppm or less, preferably 1500 ppm or less, and more preferably 1200 ppm or less. In one embodiment of the present invention, the magnet starting materials are mixed, and smelted in a high-vacuum high-frequency induction furnace. After the smelting is completed, the product is kept at 1450-1460° C. for 3-5 minutes, and then poured into a mold to cool down, thereby giving a master alloy.

<Powdering>

The step of powdering is to produce an alloy powder by pulverizing the master alloy. To prevent the master alloy as well as the coarse powder and alloy powder from being oxidized, the powdering is preferably performed in a vacuum or an inert atmosphere. The powdering preferably includes the steps of coarse pulverizing and milling described below. The coarse pulverizing is to break the master alloy into a coarse powder having a large particle size. The milling is to grind the coarse powder into the alloy powder.

The coarse pulverizing may be performed by a mechanical pulverizing process. The mechanical pulverizing process is to break the master alloy into a coarse powder using a mechanical device. The mechanical device may be a jaw pulverizer or a hammer pulverizer. The average particle diameter of the coarse powder obtained by the coarse pulverizing is 10 mm or less, preferably 1000 μm or less, and more preferably 500 μm or less.

The milling is performed by a ball milling process and/or a jet milling process. The ball milling process uses a mechanical ball mill to grind the coarse powder into the alloy powder. The mechanical ball mill may be a rolling ball mill, a vibration ball mill, or a high-energy ball mill. The jet milling process uses a gas flow to accelerate the coarse powder such that the particles of the coarse powder collide with each other and break. The gas flow may be a nitrogen flow, and preferably a high-purity nitrogen flow. The content of $N_2$ in the high-purity nitrogen flow may be 99.0 wt % or more, and preferably 99.9 wt % or more. The pressure of the gas flow may be 0.1-2.0 MPa, preferably 0.5-1.0 MPa, and more preferably 0.6-0.7 MPa. The average particle diameter of the alloy powder from the milling is 3-5 μm, preferably 3.5-4.5 μm, and more preferably 3.5-4 μm. Adjusting the rotation speed of the sorting wheels of the jet mill enables the alloy powder to have a suitable particle size.

<Mixing>

The step of mixing is to mix the alloy powder with a zirconium powder. Compared with the prior art, the present invention makes the preparation of only one alloy powder necessary because a commercially available zirconium powder suffices. As a result, the present invention is high in production efficiency and low in costs. The alloy powder is formed from the following starting materials, based on the weight of the alloy powder:

samarium 10.5-13.5 wt %,
gadolinium 12.5-15.5 wt %,
cobalt 50-55 wt %,
iron 13-17 wt %,
copper 4-10 wt %, and
zirconium 2-7 wt %.

Preferably, the alloy powder is formed from the following starting materials:

samarium 11.5-13 wt %,
gadolinium 13-14.5 wt %,
cobalt 50-53 wt %,
iron 15-17 wt %,
copper 6-10 wt %, and
zirconium 2-5 wt %.

More preferably, the alloy powder is formed from the following starting materials:

samarium 12.5-13 wt %,
gadolinium 13-13.5 wt %,
cobalt 50-51 wt %,
iron 15-16 wt %,
copper 6-8 wt %, and
zirconium 2-3 wt %.

The sum of the weight percentages of the starting materials is 100 wt %.

In one embodiment of the present invention, the alloy powder is formed from the following starting materials:

samarium 13 wt %,
gadolinium 13 wt %,
cobalt 50 wt %,
iron 15 wt %,
copper 6 wt %, and
zirconium 3 wt %.

In another embodiment of the present invention, the alloy powder is formed from the following starting materials:

samarium 12 wt %,
gadolinium 14 wt %,
cobalt 50 wt %,
iron 15 wt %,
copper 6 wt %, and
zirconium 3 wt %.

In the mixing, the weight of the zirconium powder is 0.1-0.35% of the weight of the alloy powder. Preferably, the weight of the zirconium powder is 0.1-0.3% of the weight of the alloy powder. More preferably, the weight of the zirconium powder is 0.1-0.2% of the weight of the alloy powder. This can balance the remanence and coercive force of the samarium-cobalt magnet. The time for the mixing does not need to be particularly limited, and it may be, for example, 180-300 min. The average particle diameter of the alloy powder may be 3-5 μm, preferably 3.5-4.5 μm, and more preferably 3.5-4 μm. The average particle diameter of the zirconium powder is 1-10 μm, preferably 2-8 μm, and more preferably 3-5 μm. This helps to improve the consistency between the particle size of the alloy powder and that of the zirconium, and effectively ensures that the subsequently sintered magnet has a positive temperature coefficient of remanence.

<Magnetic-Field Shaping and Isostatic Pressing>

The step of magnetic-field shaping and isostatic pressing is to form a compact by pressing the mixture from the step of mixing under the action of an orientation magnetic field, and then subject the compact to isostatic pressing to give a green compact. To prevent the mixture from being oxidized, the step of magnetic-field shaping and isostatic pressing is preferably performed in a vacuum or an inert atmosphere.

The magnetic-field shaping is preferably performed by a mold compressing method. The direction of the orientation magnetic field and the direction in which the mixture is pressed are parallel or perpendicular to each other. The intensity of the orientation magnetic field does not need to be particularly limited, and it may be determined according to actual needs. In a preferred embodiment of the present invention, the intensity of the orientation magnetic field is at least 1 Tesla (T), preferably at least 1.5 T, and more preferably 2 T or more. The pressure may be 3 MPa or more, preferably 3.5 MPa or more, and more preferably 5 MPa or more. The density of the compact may be 3.8-4.5 g/cm$^3$, and preferably 3.9-4.2 g/cm$^3$.

The isostatic pressing may be performed in an isostatic pressing machine. The compact is wrapped with a plastic bag. The plastic bag is evacuated, and then the compact is cold-isostatically pressed in an isostatic pressing machine. The pressure may be 15-24 MPa, preferably 16-23 MPa, and more preferably 18-20 MPa. The time for the pressing may be 10-30 s, and preferably 15-25 s. The density of the green compact from the isostatic pressing may be 4.8-5.4 g/cm$^3$, and preferably 5-5.3 g/cm$^3$.

<Sintering and Solution Treatment>

The step of sintering and solution treatment is to sinter the green compact so as to fix its shape and subject the sinter to solution treatment, resulting in a sintered magnet. To prevent the green compact from being oxidized, the sintering and solution treatment is preferably performed in a vacuum or an inert atmosphere, in a vacuum sintering furnace. The degree of vacuum in this step may be less than 1.0 Pa, preferably less than 0.5 Pa, and more preferably less than 0.2 Pa. The sintering temperature may be 1100-1300° C., preferably 1150-1250° C., and more preferably 1210-1230° C. The sintering time may be 0.5-1 hour, preferably 0.6-1 hour, and more preferably 0.8-1 hour. The temperature for the solution treatment may be 1100-1300° C., preferably 1150-1250° C., and more preferably 1180-1200° C. The time for the solution treatment may be 2-6 hours, preferably 3-6 hours, and more preferably 3-5 hours. After the solution treatment, the magnet is rapidly air-cooled to 20-30° C. to become a sintered magnet.

<Aging>

To prevent the sintered rare-earth magnet from being oxidized, the step of aging is preferably performed in a vacuum or an inert atmosphere. The aging temperature may be 300-900° C., and preferably 400-550° C. The aging time may be 5-28 hours, preferably 8-26 hours, and more preferably 10-25 hours. In one embodiment of the present invention, the sintered magnet is heated to 800-850° C. (preferably 800-830° C.), kept at that temperature for 10-20 hours (preferably 10-15 hours), cooled to 350-450° C. (preferably 350-400° C.) at 0.5-0.8° C./min (preferably 0.5-0.6° C./min), kept at that temperature for 4-10 hours (preferably 5-8 hours), and air-cooled to 20-30° C., thereby giving a samarium-cobalt magnet.

In one embodiment of the present invention, a mixture is formed by mixing an alloy powder with a zirconium powder in an amount of 0.1-0.35 wt % of the weight of the alloy powder. The alloy powder is formed from 10.5-13.5 wt % of samarium, 12.5-15.5 wt % of gadolinium, 50-55 wt % of cobalt, 13-17 wt % of iron, 4-10 wt % of copper, and 2-7 wt % of zirconium. The mixture is pressed while being aligned with a magnetic field in a magnetic-field pressing machine to give a compact having a density of 3.8-4.5 g/cm$^3$. The compact is wrapped with a plastic bag. The plastic bag is evacuated, and then the compact is cold isostatically pressed in an isostatic pressing machine at 15-24 MPa for 10-30 s to give a green compact having a density of 4.8-5.4 g/cm$^3$. The green compact is placed in a vacuum sintering furnace. The vacuum sintering furnace is evacuated to a vacuum degree of 0.2 Pa or less, and gradually heated. The green compact is sintered at 1210-1230° C. for 0.5-1 hour, cooled to 1200-1180° C., subjected to solution treatment for 2-6 hours, quickly air-cooled to 20-30° C., heated to 800-850° C., kept at that temperature for 10-20 hours, cooled to 350-450° C. at 0.5-0.8° C./min, kept at that temperature for 4-10 hours, and air-cooled to 20-30°, thereby giving a samarium-cobalt magnet.

<Samarium-Cobalt Magnet>

The samarium-cobalt magnet of the present invention can be prepared by the method described above. At 20-200° C., the samarium-cobalt magnet has a positive temperature coefficient of remanence α(Br), which is greater than +0.005%, and preferably greater than +0.0055%. At 150° C. it has remanence of 7.8 kGs or more, and at 150° C. it has a coercive force of 20 kOe or more. Preferably, the remanence at 200° C. is 8.2 kGs or more, and the coercive force at 200° C. is 17 kOe or more.

Methods for testing magnets obtained by the present invention will be described.

Samples of the samarium-cobalt magnets were made into standard sample columns of D10×10 mm, and magnetized to approach saturation magnetization. The sample columns were tested using a NIM-10000H hysteresigraph analyzer system in the National Institute of Metrology in China, and the temperature range is 20-200° C.

Examples 1-3 and Comparative Examples 1-2

Smelting: Starting materials of samarium, gadolinium, cobalt, iron, copper, and zirconium were smelted in accordance with the formula in Table 1 in a high-vacuum and high-frequency induction furnace, kept at 1460° C. for 5 minutes after the smelting was completed, and then poured into a mold to cool down, thereby giving a samarium-cobalt alloy.

Powdering: The samarium-cobalt alloy was mechanically broken into a coarse powder having a size of 10 mm or less (for example, 500 μm) in a jaw pulverizer, and ground into an alloy powder having an average particle size of 3.5 μm in a high-pressure jet mill.

Mixing: The alloy powder was mixed with a zirconium powder having an average particle diameter of 5 μm for 200 minutes in accordance with the formula in Table 1, thereby giving a mixture.

Magnetic-field shaping and isostatic pressing: The mixture was pressed while being aligned in a magnetic-field pressing machine to give a compact having a density of 4 g/cm$^3$. The magnetic field had intensity of 2 T, and the pressure was 5 MPa. Then, the compact was wrapped with a plastic bag. The plastic bag was evacuated, and then the compact was cold isostatically pressed at 20 MPa for 30 seconds in a high-pressure isostatic pressing machine, thereby giving a green compact having a density of 5 g/cm$^3$.

Sintering and solution treatment: The green compact was put into a vacuum sintering furnace. The vacuum sintering furnace was evacuated to a vacuum degree of 0.1 Pa, and gradually heated to 1220° C. The green compact was kept at 1220° C. for 1 hour, cooled to 1180° C., subjected to solution treatment for 3 hours, and quickly air-cooled to room temperature.

Aging: The sinter was heated to 800° C., kept at that temperature for 15 hours, cooled to 400° C. at 0.6° C./min, kept at that temperature for 6 hours, and air-cooled to room temperature, thereby giving a samarium-cobalt magnet. See Table 1 for the property of remanence of the obtained magnets.

TABLE 1

| No. | Example 1 | Example 2 | Example 3 | Comparative example 1 | Comparative example 2 |
|---|---|---|---|---|---|
| Smelting | | | | | |
| Sm (wt %) | 13 | 12 | 11 | 10 | 16 |
| Gd (wt %) | 13 | 14 | 15 | 16 | 10 |
| Co (wt %) | 50 | 50 | 50 | 50 | 50 |
| Fe (wt %) | 15 | 15 | 15 | 15 | 15 |
| Cu (wt %) | 6 | 6 | 6 | 6 | 6 |
| Zr (wt %) | 3 | 3 | 3 | 3 | 3 |
| Mixing (The amount of Zr powder is based on the weight of the alloy powder ground by a jet mill.) | | | | | |
| Zr powder (wt %) | 0.1 | 0.1 | 0.1 | 0.1 | 0.1 |
| Properties | | | | | |
| Remanence Br (kGs) at 150° C. | 8.366 | 8.155 | 7.862 | 7.737 | 7.686 |

As shown in Table 1, the remanence of the samarium-cobalt magnets at a high temperature was improved with a change in the amounts of samarium and gadolinium.

Examples 1A-1B and Comparative Examples 1A-1B

The conditions were the same as in Example 1, except that the amount of the zirconium powder added in the step of mixing was changed. See Table 2 for the amounts of samarium and gadolinium and the amount of the zirconium powder.

TABLE 2

| No. | Amount of Sm (wt %) | Amount of Gd (wt %) | Amount of Zr powder (wt %) | Remanence Br (kGs) 20° C. | 100° C. | 120° C. | 150° C. | 180° C. | 200° C. |
|---|---|---|---|---|---|---|---|---|---|
| Example 1 | 13 | 13 | 0.1 | 8.320 | 8.349 | 8.356 | 8.366 | 8.352 | 8.335 |
| Example 1A | 13 | 13 | 0.2 | 8.305 | 8.334 | 8.341 | 8.351 | 8.337 | 8.320 |
| Example 1B | 13 | 13 | 0.3 | 8.211 | 8.240 | 8.246 | 8.256 | 8.243 | 8.226 |
| Comparative example 1A | 13 | 13 | 0.4 | 8.131 | 8.159 | 8.166 | 8.176 | 8.163 | 8.146 |
| Comparative example 1B | 13 | 13 | 0.5 | 8.011 | 8.039 | 8.045 | 8.055 | 8.042 | 8.025 |

Table 2 shows how the remanence changed with the temperature. As shown in it, when the amount of the zirconium powder was controlled to be 0.1-0.35 wt %, the samarium-cobalt magnets had a positive temperature coefficient of remanence and high remanence at the high temperatures.

TABLE 3

| No. | Amount of Sm (wt %) | Amount of Gd (wt %) | Amount of Zr powder (wt %) | Coercive force Hcj (kOe) 20° C. | 100° C. | 150° C. | 180° C. | 200° C. |
|---|---|---|---|---|---|---|---|---|
| Example 1 | 13 | 13 | 0.1 | 29 | 24.24 | 21.08 | 19.02 | 17.52 |
| Example 1A | 13 | 13 | 0.2 | 29.6 | 24.81 | 21.39 | 19.41 | 17.77 |
| Comparative example 1B | 13 | 13 | 0 | 28.3 | 23.67 | 20.46 | 18.55 | 16.82 |

Table 3 shows how the coercive force changed with the temperature. As shown in it, when the amount of the zirconium powder was controlled to be 0.1-0.35 wt %, the samarium-cobalt magnets had high coercive force.

Examples 2A-2B and Comparative Examples 2A-2B

The conditions were the same as in Example 2, except that the amount of the zirconium powder added in the step of mixing was changed. See Table 4 for the amounts of samarium and gadolinium and the amount of the zirconium powder.

TABLE 4

| No. | Amount of Sm (wt %) | Amount of Gd (wt %) | Amount of Zr powder (wt %) | Remanence Br (kGs) 20° C. | 100° C. | 120° C. | 150° C. | 180° C. | 200° C. |
|---|---|---|---|---|---|---|---|---|---|
| Example 2 | 12 | 14 | 0.1 | 8.110 | 8.139 | 8.146 | 8.155 | 8.142 | 8.126 |
| Example 2A | 12 | 14 | 0.2 | 8.100 | 8.129 | 8.136 | 8.145 | 8.132 | 8.116 |
| Example 2B | 12 | 14 | 0.3 | 8.080 | 8.109 | 8.116 | 8.125 | 8.112 | 8.096 |
| Comparative example 2A | 12 | 14 | 0.4 | 8.066 | 8.095 | 8.101 | 8.111 | 8.098 | 8.082 |
| Comparative example 2B | 12 | 14 | 0.5 | 8.041 | 8.070 | 8.076 | 8.086 | 8.073 | 8.057 |

Table 4 shows how the remanence changed with the temperature. As shown in it, when the amount of the zirconium powder was controlled to be 0.1-0.35 wt %, the samarium-cobalt magnets had a positive temperature coefficient of remanence and high remanence at the high temperatures.

Examples 3A-3B and Comparative Examples 3A-3C

The conditions were the same as in Example 3, except that the amount of the zirconium powder added in the step of mixing was changed. See Table 5 for the amounts of samarium and gadolinium and the amount of the zirconium powder.

TABLE 5

| No. | Amount of Sm (wt %) | Amount of Gd (wt %) | Amount of Zr powder (wt %) | Remanence Br (kGs) 20° C. | 100° C. | 120° C. | 150° C. | 180° C. | 200° C. |
|---|---|---|---|---|---|---|---|---|---|
| Example 3 | 11 | 15 | 0.1 | 7.827 | 7.856 | 7.862 | 7.872 | 7.859 | 7.843 |
| Example 3A | 11 | 15 | 0.2 | 7.810 | 7.839 | 7.845 | 7.855 | 7.842 | 7.826 |
| Example 3B | 11 | 15 | 0.3% | 7.792 | 7.821 | 7.827 | 7.836 | 7.824 | 7.808 |
| Comparative example 3A | 11 | 15 | 0.4 | 7.779 | 7.808 | 7.814 | 7.823 | 7.811 | 7.795 |
| Comparative example 3B | 11 | 15 | 0.5 | 7.685 | 7.713 | 7.720 | 7.729 | 7.717 | 7.701 |
| Comparative example 3C | 11 | 15 | 0 | 7.830 | 7.800 | 7.780 | 7.760 | 7.720 | 7.670 |

Table 5 shows how the remanence changed with the temperature. As shown in it, compared with the sample in which no Zr powder was added, the samples during the preparation of which Zr powder was added had a positive temperature coefficient of remanence. Besides, when the amount of the zirconium powder was controlled to be 0.1-0.35 wt %, the samarium-cobalt magnets had high remanence at the high temperatures.

TABLE 6

| No. | Amount of Sm (wt %) | Amount of Gd (wt %) | Amount of Zr powder (wt %) | Coercive force Hcj (kOe) 20° C. | 100° C. | 150° C. | 180° C. | 200° C. |
|---|---|---|---|---|---|---|---|---|
| Example 3 | 11 | 15 | 0.1 | 29.02 | 24.11 | 20.83 | 18.76 | 17.00 |
| Example 3A | 11 | 15 | 0.2 | 29.01 | 24.13 | 20.89 | 18.79 | 17.26 |
| Comparative example 3C | 11 | 15 | 0 | 29.00 | 24.08 | 20.71 | 18.56 | 16.84 |

Table 6 shows how the coercive force changed with the temperature. As shown in it, when the amount of the zirconium powder was controlled to be 0.1-0.35 wt %, the samarium-cobalt magnets had high coercive force.

Comparative Example 1C-1G

The conditions were the same as in Comparative example 1, except that the amounts of the zirconium powder added in the step of mixing were changed. See Table 7 for the amounts of samarium and gadolinium and the amount of the zirconium powder.

TABLE 7

| No. | Amount of Sm (wt %) | Amount of Gd (wt %) | Amount of Zr powder (wt %) | Remanence Br (kGs) 20° C. | 100° C. | 120° C. | 150° C. | 180° C. | 200° C. |
|---|---|---|---|---|---|---|---|---|---|
| Comparative example 1 | 10 | 16 | 0.1 | 7.692 | 7.721 | 7.727 | 7.737 | 7.724 | 7.709 |
| Comparative example 1C | 10 | 16 | 0.2 | 7.603 | 7.632 | 7.638 | 7.647 | 7.635 | 7.620 |
| Comparative example 1D | 10 | 16 | 0.3 | 7.562 | 7.591 | 7.597 | 7.606 | 7.594 | 7.579 |
| Comparative example 1F | 10 | 16 | 0.4 | 7.524 | 7.553 | 7.559 | 7.568 | 7.556 | 7.541 |
| Comparative example 1G | 10 | 16 | 0.5 | 7.483 | 7.511 | 7.517 | 7.526 | 7.514 | 7.499 |

Table 7 shows that when the amounts of samarium and gadolinium were not suitable, changing the amount of the Zr powder would make it impossible to obtain a samarium-cobalt magnet having high remanence at a high temperature.

The present invention is not limited to the embodiments described above. Any variation, improvement, or substitution which those skilled in the art can think of but which does not depart from the essence of the present invention falls into the scope of the present invention.

What is claimed is:

1. A method for preparing a samarium-cobalt magnet, comprising:

smelting starting materials to obtain a master alloy; wherein the starting materials consist of the following elements, based on the weight of an alloy powder: 13 wt % of samarium, 13 wt % gadolinium, 50 wt % of cobalt, 15 wt % of iron, 6 wt % of copper, and 3 wt % of zirconium; wherein the sum of the weight percentages of the starting materials being 100 wt %;

pulverizing the master alloy to produce the alloy powder; wherein the alloy powder has an average particle diameter of 3.5-4 μm;

mixing the alloy powder with a zirconium powder to form a mixture; wherein the weight of the zirconium powder is 0.1% of the weight of the alloy powder, and the zirconium powder has an average particle diameter of 3-5 μm; and subjecting the mixture to post-processing, wherein the post-processing comprises magnetic-field shaping, isostatic pressing, sintering and solution treatment, and aging;

wherein the magnetic-field shaping is to press the mixture under an action of an alignment magnetic field in a magnetic field press machine to give a compact having a density of 3.9-4.2 g/cm$^3$;

wherein the isostatic pressing is to wrap the compact with a plastic bag, evacuate the plastic bag, and then cold-isostatically press the compact in an isostatic pressing machine at 18-20 MPa for 15-25 seconds to give a green compact having a density of 5-5.3 g/cm$^3$;

wherein the sintering and solution treatment is to place the green compact in a vacuum sintering furnace, evacuate the vacuum sintering furnace to a vacuum degree of 0.2 Pa or less, gradually heat the green compact, and sinter the green compact at 1210-1230° C. for 0.8-1 hour to give a sinter, cool the sinter to 1180-1200° C., perform solution treatment of the sinter for 3-5 hours, and air cool the sinter to 20-30° C.;

wherein the aging is to heat the sinter to 800-830° C., keep it at that temperature for 10-15 hours, cool it to 350-450° C. at 0.5-0.6° C./min, keep it at that temperature for 5-8 hours, and air cool it to 20-30° C., thereby giving the samarium-cobalt magnet.

* * * * *